US006899664B2

(12) United States Patent
Gale

(10) Patent No.: US 6,899,664 B2
(45) Date of Patent: May 31, 2005

(54) DEVICE FOR RETURNING FOLDED PAPER AND FOLDING APPARATUS INCLUDING SAME

(76) Inventor: Gregory R. Gale, 8082 Augusta La., Sagamore Hills, OH (US) 44067

( * ) Notice: Subject to any disclaimer, the term of this patent is extended or adjusted under 35 U.S.C. 154(b) by 0 days.

(21) Appl. No.: 10/669,187

(22) Filed: Sep. 24, 2003

(65) Prior Publication Data

US 2005/0065008 A1 Mar. 24, 2005

(51) Int. Cl.[7] ..... B31F 1/00

(52) U.S. Cl. ..... 493/405; 493/356; 493/79; 493/421; 271/272; 271/198

(58) Field of Search ..... 493/405, 356, 493/79, 151, 420, 419, 421; 271/272, 198

(56) References Cited

U.S. PATENT DOCUMENTS

| | | | | |
|---|---|---|---|---|
| 3,206,191 | A * | 9/1965 | Hantscho | 493/405 |
| RE29,178 | E * | 4/1977 | Colwill | 209/318 |
| 4,269,402 | A * | 5/1981 | Fischer et al. | 493/437 |
| 4,481,007 | A | 11/1984 | Hornung | |
| 4,518,380 | A | 5/1985 | Shimizu et al. | |
| 4,834,699 | A | 5/1989 | Martin | |
| 4,869,712 | A | 9/1989 | Ishino | |
| 4,944,131 | A | 7/1990 | Gough | |
| 5,150,891 | A * | 9/1992 | Svyatsky et al. | 271/35 |
| 5,246,415 | A | 9/1993 | Fuss | |
| 5,342,038 | A * | 8/1994 | Suter | 271/198 |
| 5,344,379 | A | 9/1994 | Garrone | |
| 5,358,234 | A * | 10/1994 | Boriani et al. | 271/225 |
| 5,439,206 | A | 8/1995 | Raasch et al. | |
| 5,465,825 | A * | 11/1995 | Levaro et al. | 198/444 |
| 5,520,603 | A | 5/1996 | Bluthardt et al. | |
| 5,542,349 | A * | 8/1996 | Gosslinghoff | 100/161 |
| 5,766,122 | A | 6/1998 | Hamilton | |
| 5,775,689 | A * | 7/1998 | Moser et al. | 271/198 |
| 5,803,890 | A | 9/1998 | Zechner | |
| 5,871,433 | A | 2/1999 | Lehmann et al. | |
| 6,224,530 | B1 | 5/2001 | Okelmann et al. | |
| 6,378,865 | B1 * | 4/2002 | Brotherston et al. | 271/272 |
| 6,383,124 | B1 | 5/2002 | St. Germain et al. | |
| 6,475,129 | B1 | 11/2002 | Lehmann | |
| 6,554,271 | B1 | 4/2003 | Lindsay et al. | |

OTHER PUBLICATIONS

MBO America—Internet Page Printout—Paper Folding Machine (2 pages).

* cited by examiner

*Primary Examiner*—Sameh H. Tawfik
(74) *Attorney, Agent, or Firm*—Curatolo Sidoti Co., LPA

(57) ABSTRACT

A folded paper return device is provided for use in combination with a sheet material folding machine, such as a paper folding machine. A paper folding machine including the inventive folded paper return device is also provided. The sheet material folding machine is particularly suited for folding sheets of paper.

12 Claims, 5 Drawing Sheets

DEVICE FOR RETURNING FOLDED PAPER AND FOLDING APPARATUS INCLUDING SAME

BACKGROUND

Paper folding machines are well known in the paper handling industry. In general, paper folding machines have the capability of performing folding operations on lengths of continuous sheets or multiple separate sheets of paper that are continuously fed into the paper folding machine.

One type of paper folding machine commonly used is known as a buckle-type paper folding machine. An example of a buckle-type machine is illustrated in U.S. Pat. No. 4,834,699 to Martin entitled "Buckle Chute Paper Folding Apparatus." In a buckle-type machine, a piece of paper is fed or pulled through two elongated adjacent rollers that direct the leading edge of the piece of paper into a tray or a chute that is of a finite length and which stops the leading edge of the paper at a predetermined distance from the rollers. Once the leading edge hits the end of the chute, the paper is confined as it is buckled by the first pair of rollers which are still advancing the sheet of paper. The buckled portion of the piece of paper is then caught between another pair of rollers positioned next to the first pair of rollers. The second pair of rollers pull the buckled portion through, thereby creating a folded piece of paper.

In the operation of a paper folding machine, the operator loads a desired quantity of paper sheets onto a sheet feeder at a paper loading area. The loaded sheets of paper to be folded are sequentially fed by the sheet feeder along a feed path into a folding mechanism. The leading edge of the paper sheets are drawn into the folding mechanism, which is located downstream from the sheet feeder. Once drawn into the folding mechanism, the paper sheets are sequentially folded by folding roller pairs. Once folded, the paper sheets are sequentially discharged from the folding mechanism at a location that is remote from the location where the operator loads the unfolded paper sheets to be folded.

Because the folded paper sheets are discharged from the paper folding machine at a location that is different and remote from the location where the paper is loaded, a single operator is must continually travel between the two locations (i.e.-between the paper loading location and paper discharge location) throughout the paper folding process. This results in a reduction in the productivity of the paper folding process. Alternatively, the productivity of the paper folding process can be maintained through the use of an additional operator to collect the folded paper that is discharged from the folding mechanism. However, the use of an additional operator in the paper folding process results in an increase in labor costs.

Therefore, it is desirable in the paper handling art to provide a return device to return folded paper to the operator of the folding machine at or near the location where the paper sheets to be folded are loaded onto the sheet feeder. It is desirable that the paper return device is easily integrated into a paper folding machine, that the use of the paper return device reduces the space required by the paper folding machine, that the paper return device permits easy and efficient operation of the folding machine by a single operator, and that the paper return device increases the productivity of the paper folding process, while reducing the labor efforts of the operator.

SUMMARY

A device is provided for returning folded paper at or near an input end of a sheet feeder of a paper folding apparatus comprising a first conveyer system including a first endless conveyer belt, a first driven roller, and at least one freely rotatable guide roller, wherein said first conveyer belt is wrapped around said first driven roller and said at least one freely rotatable guide roller, wherein said first driven roller is rotatable in a counter-clockwise direction thereby driving said first endless conveyer belt in a first direction, and said at least one freely rotatable guide roller supports said first conveyer belt; and a second conveyer system including a second endless conveyer belt, and at least one freely rotatable guide roller, wherein said second conveyer belt is wrapped around said at least one freely rotatable guide roller, said at least one freely rotatable guide roller rotates in a direction opposite to said first driven roller, and said second conveyer system is located underneath said first conveyer system.

A paper folding apparatus is also provided comprising a frame; a sheet feeder supported by said frame for delivering sheets of paper to a sheet folding mechanism, said sheet feeder having a proximal end and a distal end; a paper folding mechanism located downstream from said distal end of said sheet feeder; a device for returning folded paper near said proximal end of said sheet feeder, said device mounted on said frame below said sheet feeder, wherein said device comprises a first conveyer system including a first endless conveyer belt, a first driven roller, and at least one freely rotatable guide roller, wherein said first conveyer belt is wrapped around said first driven roller and said at least one freely rotatable guide roller, said first driven roller is selectively rotatable in a clockwise direction and a counter-clockwise direction thereby driving said first endless conveyer belt in a first direction, and said at least one freely rotatable guide roller supports said first conveyer belt; and a second conveyer system including a second endless conveyer belt, and at least one freely rotatable guide roller, wherein said second conveyer belt is wrapped around said at least one freely rotatable guide roller, said at least one freely rotatable guide roller rotates in a direction opposite to said first driven roller, and said second conveyer system is located underneath said first conveyer system; and means for driving said sheet feeder, said folding mechanism and said device for returning folded paper.

DETAILED DESCRIPTION OF THE PREFERRED EMBODIMENTS

A sheet material folding apparatus is provided that includes a frame, means for delivering sheet materials to be folded to a folding unit or mechanism, at least one sheet folding unit or mechanism and a folded paper return device for discharging folded sheet materials from the paper folding apparatus to a desired location. The folding apparatus is particularly useful for high-speed folding of paper sheets.

Figure 1:
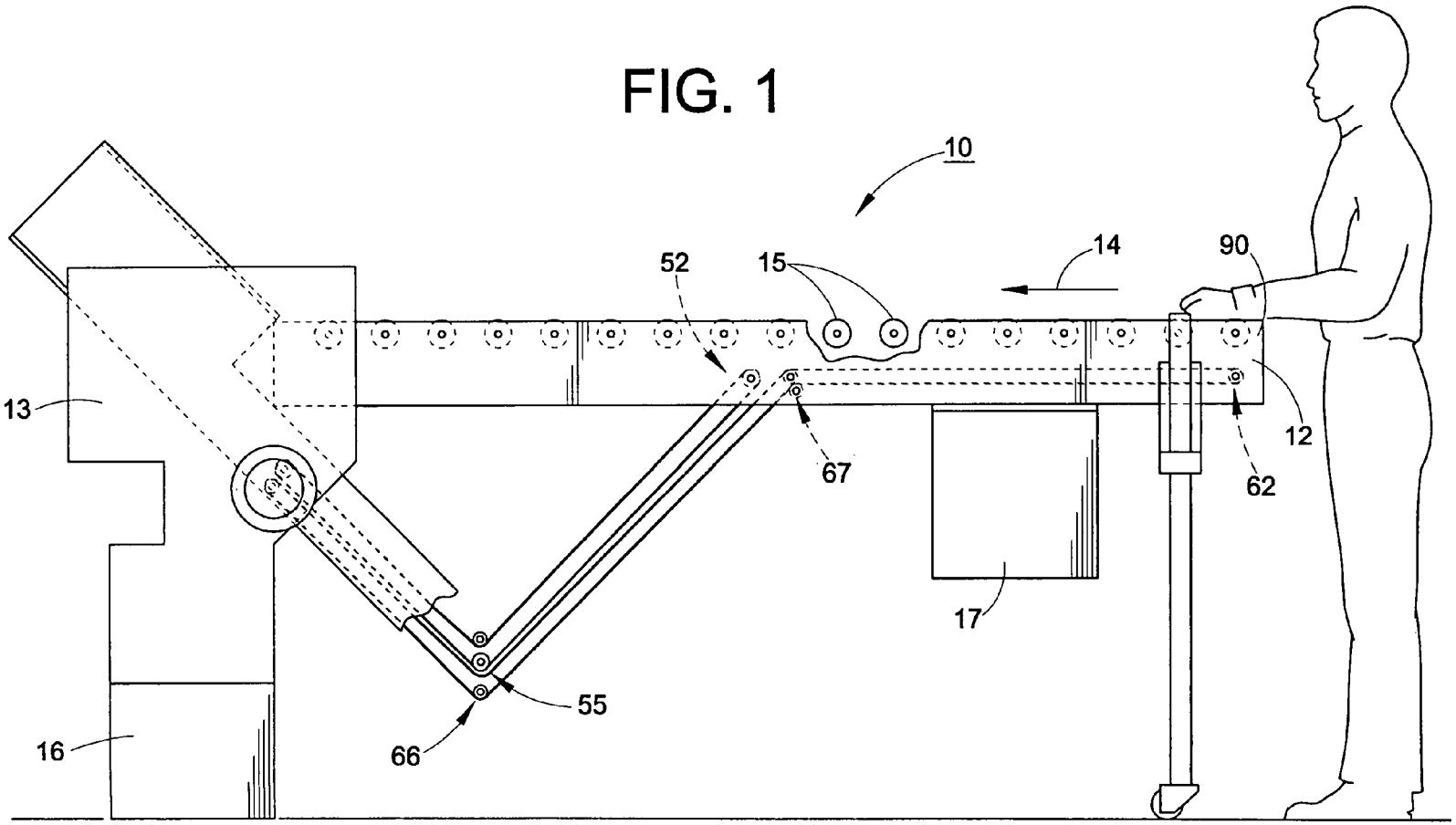
FIG. 1 is a side view of a paper folding apparatus 10 incorporating the return sheet folding device.

Referring to FIG. 1, there is shown a paper folding apparatus or machine 10. The paper folding machine 10 includes a frame 12. The frame 12 supports means for transporting, delivering or otherwise inputting sheet materials to a folding mechanism (not shown) located within housing 13, which is located downstream from the means for delivering paper to the folding mechanism. According to the embodiment shown in FIG. 1, the means for delivering paper materials to be folded to the folding mechanism includes a plurality of parallel, spaced apart, feed rollers 15. The plurality of feed rollers 15 are supported by frame 12. The feed rollers 15 are rotated or driven by a drive mechanism that is incorporated into the frame 12 the paper folding apparatus 10. The motor driven rollers 15 drive or feed the paper sheets along a paper feed path 14 in a direction that is toward the downstream folding mechanism.

Still referring to FIG. 1, housing 16 houses an electric motor that is utilized to provide the various components of the paper folding apparatus 10, including the folded paper return device, with motion. Housing 17 is disposed beneath the paper folding apparatus 10, and houses the necessary components to run the electric motor such as, for example, controllers, transformers, relays and the like for the variable speed electric motor.

While FIG. 1 illustrates an embodiment of the invention that utilizes a plurality of motor driven feed rollers 15, it should be noted that any mechanism, such as driven conveyer belts and the like, that can be supported by frame 12 and can deliver or transport unfolded sheets of paper to the folding mechanism of the paper folding machine 10 in a sequential manner, can be utilized in lieu of the motor driven feed rollers 15.

Figure 2:
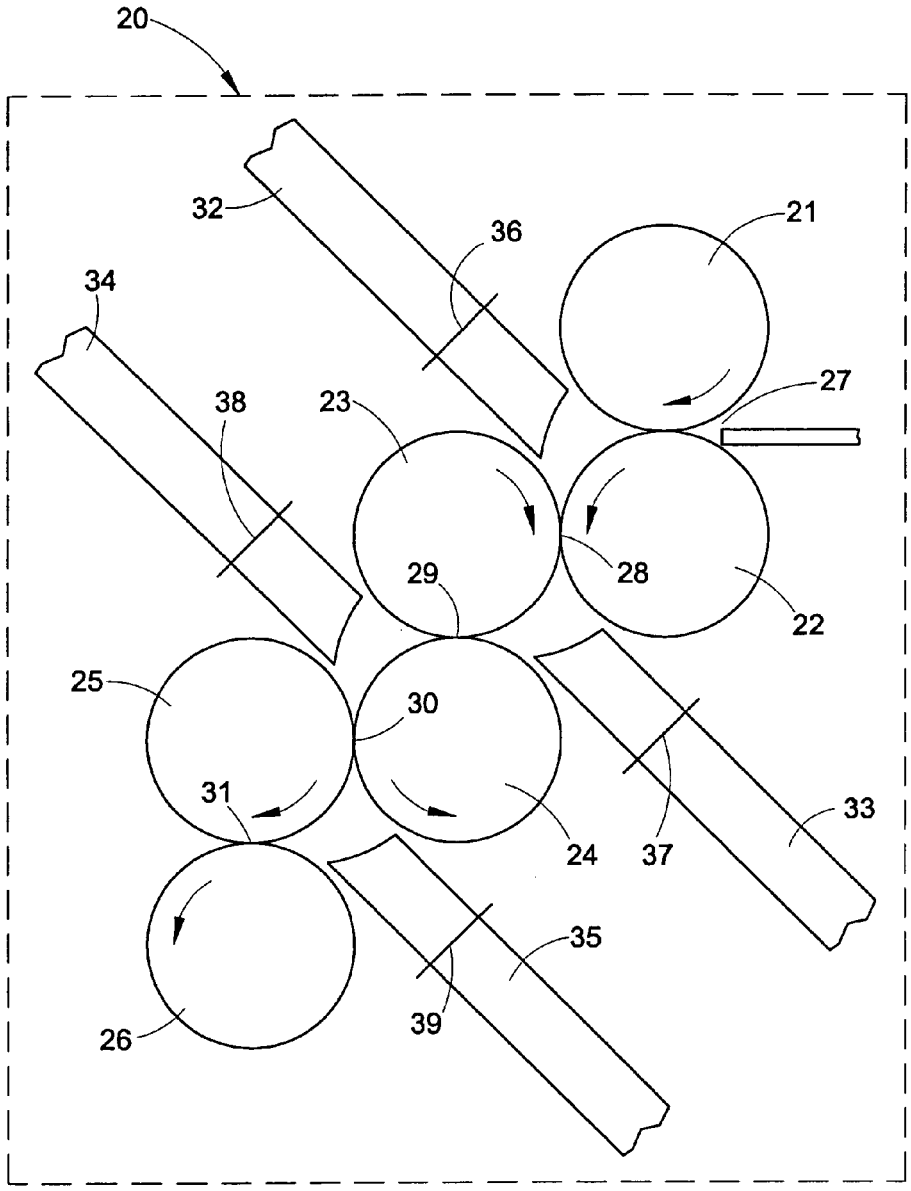
FIG. 2 is a schematic representation of one embodiment of the folding mechanism 20 of the paper folding apparatus 10.

The folding mechanism will now be described with reference to FIG. 2. Referring to FIG. 2, the paper folding apparatus 10 includes a folding mechanism 20 located downstream from the sheet feeder means 15. The folding mechanism 20 of the paper folding apparatus 10 generally includes a plurality of rollers 21–26. The sheet folding rollers are rotatably supported by a frame (not shown) and are driven by an electric motor (not shown). Folding mechanism 20 includes a plurality of rollers forming roller pairs. Rollers 21 and 22 form a roller pair for drawing the leading edge of the paper to be folded into the folding mechanism 20. The first roller pair includes first 21 and second 22 rollers cooperating to form a sheet intake site 27 for feeding in individual sheets into the folding mechanism 20. Rollers 22 and 23 form a first sheet folding roller pair. Rollers 22 and 23 cooperate to form a folding point 28 to introduce a fold in a sheet of paper. Rollers 23 and 24 form a second sheet folding roller pair. Rollers 23 and 24 cooperate to form a folding point 29 to introduce another fold in a sheet of paper. Rollers 24 and 25 form a third sheet folding roller pair. Rollers 24 and 25 cooperate to form a folding point 30 to introduce an additional fold in a sheet of paper. Rollers 25 and 26 form a fourth sheet folding roller pair. During typical operation without the inventive paper return device, rollers 25 and 26 cooperate to form a folding point 31 to introduce a further fold in a sheet of paper.

At least one folding pocket 32–35 is associated with said folding mechanism 20. Folding pockets 32, 34 are generally positioned outwardly and upwardly, and folding pockets 33, 35 are generally positioned outwardly and downwardly, in relation to the feed path 14 of the paper entering the folding mechanism 20. The folding pockets 32–35 may include a transversely disposed paper stops 36–39 that may be adjusted to a stop surface position to form a stop plane corresponding to a sheet feed length. The stop surface is generally positionable at a location spaced from a folding pocket intake by a distance for receiving a full length of each sheet in the folding pocket 32–35. According to the embodiment shown in FIG. 2, the folding mechanism 20 of paper folding apparatus 10 includes four folding pockets 32–35. Folding pockets 32–35 equipped with paper stops 36–39 can be automatically or manually controlled by the operator. Furthermore, the folding pockets may be equipped with deflectors to prevent entry of paper into the folding pocket.

Figure 4:
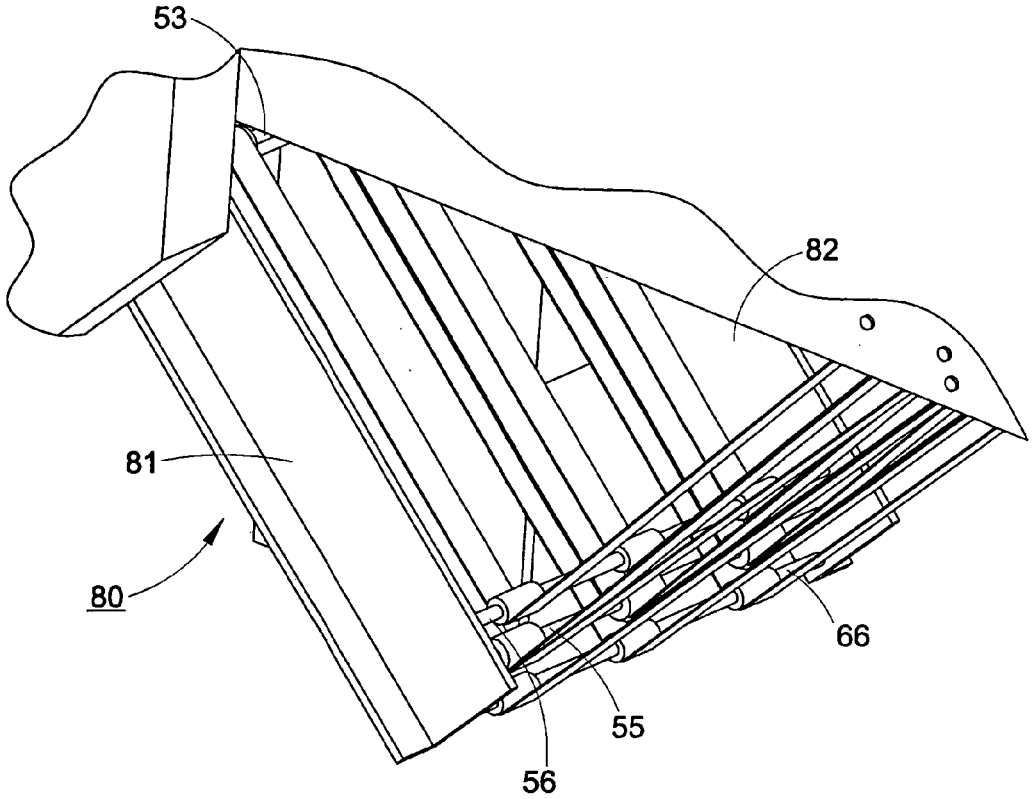
FIG. 4 is a representation of a perspective view one embodiment of the folding mechanism 20 of the paper folding apparatus 10 having the inventive folded paper return device installed in fourth folding position of the folding mechanism 20.

Referring to FIG. 4, the paper folding apparatus 10 is fitted with a folded paper return device 40. In the embodiment shown, the downwardly and outwardly disposed folding pocket 39 occupying the fourth folding pocket position of the paper folding mechanism 20 is removed. The folded paper return device generally includes a conveyer belt system including at least two strategically positioned conveyer belts, drive rollers for driving the conveyer belts, guide rollers for guiding and supporting the guide rollers and a frame for mounting several guide rollers. The frame 80 of the paper return device 40 includes spaced apart, opposing side plates 81, 82. Guide rollers, 53, 55, 56, and 66 extend between frame side plates 81, 82, and are thereby supported by frame 80. The guide rollers 53, 55, 56 66 are mounted on the frame 80 in such a manner to permit free rotation of the guide rollers. The frame portion 80 of the folded paper return device is positioned into and engaged with the fourth folding pocket position of the paper folding mechanism 20. According to this construction, the frame portion of the folded paper return device 40 is positioned in the fourth folding pocket position and is disposed in a downwardly and outwardly fashion.

Figure 3:
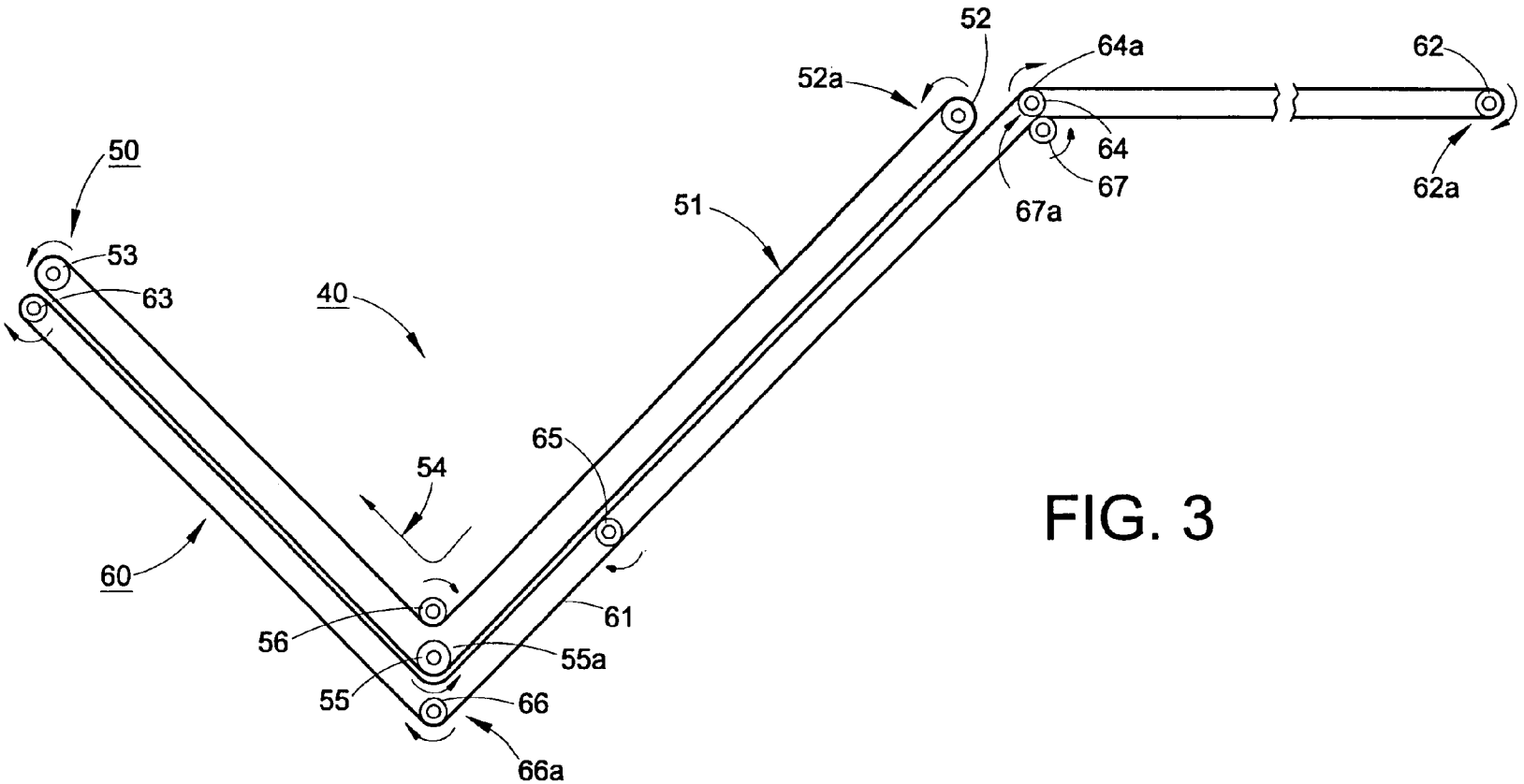
FIG. 3 is a schematic representation of a side view of the conveyer belt system of the return paper device 40 of the present invention.

The conveyer belt system of the folded paper return device 40 will now be described with reference to FIG. 3. Referring to FIG. 3, the folded paper return device 40 is a belt-type return mechanism. The return device 40 includes a first conveyer system 50 including a first continuous or endless conveyer belt 51, a first driven roller 52, and at least one freely rotatable guide roller 53. The first conveyer belt 50 is wrapped around the first driven roller 52 and the at least one freely rotatable guide roller 53. The first driven roller 52 is freely rotatable in a first direction, preferably, in a counterclockwise direction, in relation to the feed path 14 of the unfolded paper sheets, thereby driving said first endless conveyer belt 51 in a first direction 54. Direction 54 is opposite to the direction of the feed path 14 shown in FIG. 1. The at least one freely rotatable guide roller 53 provides support for the first conveyer belt 51. First conveyer belt 51 may be wrapped around additional guide roller 55 and may travel along and contact with additional guide roller 56 to provide further guidance and support to the first conveyer belt 51. Additional guide rollers 55 and 56 are freely rotatable, and, if desired, may be motor driven.

The folded paper return device 40 also includes a second conveyer system 60 that includes a second continuous or endless conveyer belt 61, includes drive roller 62, and at least one freely rotatable guide roller 63. The second conveyer belt 61 is wrapped around drive roller 62 and freely rotatable guide roller 63. The driven roller 62 and the at least one freely rotatable guide roller 63 rotate in a direction that is opposite to said first driven roller 52. Second conveyer belt 61 may travel along the rolling surfaces of additional guide rollers 64, 65, 66 and may travel along and contact additional guide roller 67 to provide further guidance and support to the second conveyer belt 61. Additional guide rollers 64–67 are freely rotatable, and, if desired, may be motor driven. The second conveyer system 60 is located underneath the first conveyer system 50.

The first 50 and second conveyer 60 systems may include one or more continuous or endless conveyer belts for transporting folded paper sheets to the desired location at, near or around the paper loading area of the paper folding apparatus 10. Now referring to FIG. 4, in one embodiment, the first conveyer system 50 of the folded paper return device 40 includes three, spaced apart, endless conveyer belts 71–73 that are wrapped around said first driven roller 74.

Referring to FIGS. 1 and 3, first conveyer belt 51 travels in a path downwardly and outwardly from the folding mechanism 20 of the folding apparatus 10. First conveyer belt is disposed above second conveyer belt 61, but below the horizontally disposed log feed rollers 15. First conveyer belt 51 travels in a downwardly and outwardly path from the folding mechanism until it reaches a point 55*a* near guide roller 55. Near point 55*a*, the first conveyer belt 51 travel path changes to an upwardly path directed toward the horizontally disposed log feed rollers 15 until it reaches point 52*a* near driven roller 52. The first belt 51 wraps around roller 52 and continues back to folding mechanism 20.

Second conveyer belt 61 is disposed below first conveyer belt 51. Second conveyer belt 61 travels downwardly and outwardly from the folding mechanism 20 of the paper folding apparatus 10. Second conveyer belt 61 travels downwardly and outwardly until it reaches point 66*a* near guide roller 66, wherein the path of the second conveyer belt 61 changes to upwardly and is directed toward the plurality of horizontally disposed log feed rollers 15. Second conveyer belt 61 continues to travel upwardly toward the feed rollers 15 until it reaches point 64*a*, where the travel path bends and the second conveyer belt continues to travel a along a path that is substantially parallel to the plurality of log feed rollers 15 until it reaches a point 62*a* near the proximal input end 90 of the sheet feeder means where the folded paper is discharged.

During operation of the paper folding machine, folded sheets of paper are discharged from the folding mechanism 20 by the conveyer belt system. The sheets of folded paper travel in the gap between first conveyer belt 51 and second conveyer belt 61 until the paper reaches point 64*a*, wherein the first conveyer belt 51 wraps around roller 52 and continuous back toward folding mechanism 20. Essentially, the folded paper sheets are "sandwiched" between the first conveyer belt 51 and the second conveyer 61 from a point near guide rollers 53, 63 to a point near driven roller 52 of the first conveyer belt system and guide roller 64 of the second conveyer belt system. As described above, first conveyer belt 51 wraps around driven rollers 52 and continues to travel back toward the folding mechanism 20 along guide rollers 53, 56. Meanwhile, the folded sheets of paper continue to travel on the second conveyer belt 61 in the space between the bottom surfaces of the horizontally disposed log feed rollers 15 and the second conveyer belt 61 until the discharge point 90 is reached at a location at, near or around the paper loading area of the paper folding machine. Second conveyer belt 61 wraps around driven roller 62 and travels back toward the paper folding mechanism 20 along guide rollers 66, 67.

Figure 5:
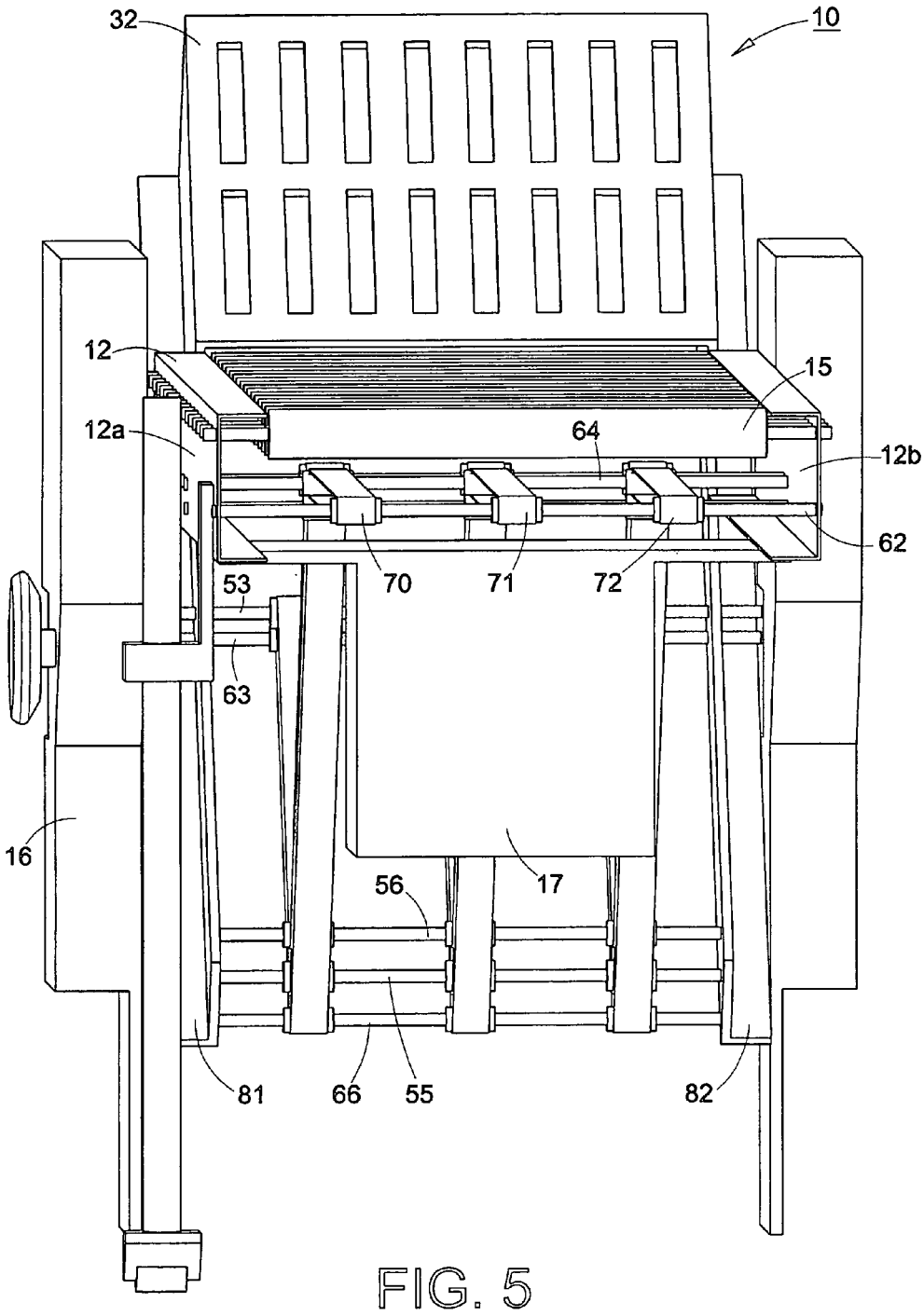
FIG. 5 is an end perspective view of the paper folding apparatus of the present invention illustrating the second conveyer system 60 having three conveyer belts wrapped around drive roller 62.

As shown in FIG. 5, according to one embodiment, the second conveyer system 60 may include three endless conveyer belts 70–72 wrapped around a second driven roller 62.

In preferred embodiment, the first conveyer system includes three endless conveyer belts wrapped around a first driven roller, and the second conveyer system includes three endless conveyer belts wrapped around a driven roller.

The conveyor belts are detachably mounted to the folding mechanism 20 and frame 12 and to the folding mechanism 20 via the driven rollers and the freely rotatable guide rollers. As shown in FIG. 1, the folded paper return device 40 is positioned below feed rollers 15 of the folding apparatus 10. The driven rollers 53, 62 extend laterally between opposing frame plates 12*a*, 12*b* of frame 12. Guide rollers 64, 67 extend laterally between frame plates 12*a*, 12*b* of frame 12. Guide rollers 53, 55, 56, 63, 65, and 66 extend laterally between opposing frame plates 81, 82 of frame 80 of the paper return device 40. The laterally disposed guide rollers and driven rollers are coaxially fitted with free wheeling rollers to facilitate movement of conveyer belts 51, 61 over the guide and driven rollers, and to provide a mechanism to prevent the conveyer belts from translating along the length of the guide and/or driven rollers during operation of the paper return device.

To provide motion to the various components of the paper folding apparatus a conveniently controlled electric motor is incorporated into the paper folding apparatus. According to one embodiment of the invention, the sheet feeder, the folding mechanism, and the folded paper return device can be driven by a common motor. In an alternative embodiment, the sheet feeder, the folding mechanism, and the folded paper return device can each be driven by separate motors.

In operation, sheets materials, such as paper sheets having a leading edge and a trailing edge, are conveyed by the motor driven feed rollers of the sheet feeder the along a feed path to the downstream folding mechanism. Once introduced into the folding mechanism, the paper sheets are folded by the folding roller pairs.

When the folding operation is complete, the folded sheets of paper are sequentially discharged from the folding mechanism by the inventive paper return device. The folded paper return device utilizes the conveyer belt system to deliver folded sheets of paper to a location that is at, near or around the paper loading area of the paper folding machine. The folded paper sheets rest upon the second conveyer belt and are returned to a location that is at, near or around the paper loading area of the paper folding machine by traveling on the second conveyer belt along a return paper path in the space between the lower surfaces of the rotating feed rollers of the sheet feeder and the second conveyer belt, and are discharged from the paper folding machine at a discharge point located at, near or around the loading area of the paper folding machine.

The driven log feed rollers 15 of the sheet feeder means freely rotate in a direction that is toward the downstream paper folding mechanism. The second guide rollers and second driven rollers of the second conveyer systems freely rotate in a direction that is toward the loading area of the paper folding machine, near the proximal end of the sheet feeder means. Accordingly, a portion of the second conveyer belt 51 of the second conveyer system of the inventive paper return device works in cooperation with the existing driven log rollers 15 of the sheet feeder of the paper to transport or otherwise deliver the folded paper sheets to a location that is at, near or around the paper loading area of the folding machine.

EXAMPLE

The following example is set forth to further illustrate the inventive paper return device. The example should not be construed as limiting the present invention in any manner.

To illustrate the operation of the inventive paper return device, a Model B26 sixteen page paper folding machine commercially available from MBO America (Westhampton, N.J.) was fitted with the inventive paper return device. Referring now to FIG. 4, the folding unit of the Model B26 paper folding machine includes two upwardly and outwardly disposed folding pockets 32, 34 and two downwardly and outwardly disposed folding pockets 33, 35. Typically in practice, the upwardly and outwardly disposed folding pocket 32 occupies a first folding pocket position and upwardly and outwardly disposed folding pocket 34 occupies a third folding pocket position. Likewise, downwardly and outwardly disposed folding pocket 33 occupies a second folding pocket position, and downwardly and outwardly disposed folding pocket 35 occupies a fourth folding pocket position. Downwardly and outwardly disposed folding pocket 35 occupying the fourth folding pocket position of the folding machine was removed from the folding mechanism. The frame portion 80 of the folded paper return device 40 was positioned into and engaged with the fourth folding pocket position of the paper folding machine. According to this construction, the frame portion 80 of the folded paper return device is positioned in the fourth folding pocket positions and is disposed in a downwardly and outwardly fashion. Drive rollers 52, 62 were mounted on frame 12 of the machine 10 and the first and second conveyer belt systems were engaged with the drive and guide rollers.

The use of the folded paper return device in the fourth folding position of the Model B26 paper folding apparatus was successful in sequentially returning folded paper sheets to a desired location at, near, or around the paper loading area 90 of the paper folding apparatus 10. The rate of return achieved with the folded paper return device 40 was substantially equal to the rate of input of unfolded paper sheets into the paper folding apparatus 10. This enables the operator of the paper folding machine to maintain a high level of productivity in the paper folding operation.

As described above, the folded paper return device is easily integrated into a paper folding machine.

The use of the inventive product delivery system in combination with a paper folding apparatus permits operation of the folding apparatus by a single worker, thereby reducing personnel costs.

The use of the inventive product delivery system in combination with a paper folding apparatus also reduces the work space required by the paper folding apparatus.

The use of the inventive product delivery system in combination with a paper folding apparatus also reduces the distance between the paper feeder and the paper delivery, thereby increasing the efficiency of the paper folding process while reducing the labor on the efforts operator.

Therefore, a sheet folding apparatus having an improved folded sheet materials device is provided for efficient folding and collection of folded sheet materials. It should be understood that the present invention is not limited to the specific embodiments described above, but includes the variations, modifications and equivalent embodiments that are defined below. The embodiments that are disclosed separately are not necessarily in the alternative, as various embodiments of the invention may be combined to provide the desired characteristics.

I claim:

1. A device for returning folded paper at, near or around a paper input end of a paper folding apparatus comprising:

a frame comprising opposing side plates;

a first conveyer system including a first endless conveyer belt, a first driven roller, and at least one freely rotatable guide roller, wherein said first conveyer belt is wrapped around said first driven roller and said at least one freely rotatable guide roller, wherein said first driven roller is rotatable in a counter-clockwise direction thereby driving said first endless conveyer belt in a first direction, and said at least one freely rotatable guide roller guides and supports said first conveyer belt; and a second conveyer system including a second endless conveyer belt, and at least two freely rotatable guide rollers, wherein said second conveyer belt is wrapped around said at least two freely rotatable guide rollers, said at least two freely rotatable guide rollers rotate in a direction opposite to said first driven roller, and said second conveyer system is located underneath said first conveyer system;

wherein said guide rollers extend between said opposing side plates of said frame, and wherein said first driven roller is adapted to be mounted to the existing frame of a paper folding machine to guide said folded paper back to said input end.

2. The device of claim 1, wherein said a second conveyer system includes a second endless conveyer belt, a second driven roller, and at least two freely rotatable guide rollers, wherein said second conveyer belt is wrapped around said second driven roller and said at least two freely rotatable guide rollers, said at least two freely rotatable guide rollers rotate in a direction opposite to said first driven roller.

3. The device of claim 2, wherein said first conveyer system includes three endless conveyer belts wrapped around said first driven roller.

4. The device of claim 2, wherein said second conveyer system includes three endless conveyer belts wrapped around said second driven roller.

5. The device of claim 2, wherein said first conveyer system includes three endless conveyer belts wrapped around said first driven roller, and wherein said second conveyer system includes three endless conveyer belts wrapped around said driven roller.

6. A paper folding apparatus comprising:

a frame;

a sheet feeder supported by said frame for delivering sheets of paper to a sheet folding mechanism;

a paper folding mechanism located downstream from said sheet feeder;

a device for returning folded paper to said input end of said sheet feeder, said device disposed underneath said sheet feeder and folding mechanism, wherein said device comprises a frame comprising opposing side plates, a first conveyer system including a first endless conveyer belt, a first driven roller, and at least one freely rotatable guide roller, wherein said first conveyer belt is wrapped around said first driven roller and said at least one freely rotatable guide roller, wherein said first driven roller is rotatable in a counter-clockwise direction thereby driving said first endless conveyer belt in a first direction, and said at least one freely rotatable guide roller guides and supports said first conveyer belt, and a second conveyer system including a second endless conveyer belt, and at least two freely rotatable guide rollers, wherein said second conveyer belt is wrapped around said at least two freely rotatable guide rollers, said at least two freely rotatable guide rollers rotate in a direction opposite to said first driven roller, and said second conveyer system is located underneath said first conveyer system, wherein said guide rollers extend between said opposing side plates of said frame, and wherein said driven roller is adapted to be mounted to the existing frame of a paper folding machine; and means for driving at least one of said sheet feeder, said folding mechanism and said device for returning folded paper.

7. The paper folding apparatus of claim 6, wherein said a second conveyer system includes a second endless conveyer belt, a second driven roller, and at least two freely rotatable guide rollers, wherein said second conveyer belt is wrapped around said second driven roller and said at least two freely rotatable guide rollers, said at least two freely rotatable guide rollers rotate in a direction opposite to said first driven roller.

8. The paper folding apparatus of claim 7, wherein said first conveyer system includes three endless conveyer belts wrapped around said first driven roller.

9. The paper folding apparatus of claim 7, wherein said second conveyer system includes three endless conveyer belts wrapped around said second driven roller.

10. The device of claim 7, wherein said first conveyer system includes three endless conveyer belts wrapped around said first driven roller, and wherein said second conveyer system includes three endless conveyer belts wrapped around said driven roller.

11. The apparatus of claim 6, wherein the means for driving at least one of said sheet feeder, said folding mechanism and said sheet return device is a motor.

12. The paper return device of claim 6, wherein said first conveyer system is V-shaped and said second conveyer system is V-shaped with one of the legs of the V-shape bending parallel to the sheet feeder.

* * * * *